US005313027A

United States Patent [19]

Inoue et al.

[11] Patent Number: 5,313,027

[45] Date of Patent: May 17, 1994

[54] PUSH BUTTON SWITCH ASSEMBLY INCLUDING SINGLE OR PLURAL SEQUENTIALLY CLOSED SWITCHES

[75] Inventors: Kenji Inoue, Hirakata; Futoshi Matsui, Tsuyama; Kouichi Santo, Hirakata, all of Japan

[73] Assignee: Matsushita Electric Industrial Co., Ltd., Osaka, Japan

[21] Appl. No.: 30,838

[22] Filed: Mar. 12, 1993

[30] Foreign Application Priority Data

Mar. 16, 1992 [JP] Japan ..... 4-057634

[51] Int. Cl.[5] ..... H01H 13/70; H01H 1/06

[52] U.S. Cl. ..... 200/5 A; 200/1 B; 200/513

[58] Field of Search ..... 200/1 R, 5 R, 5 A, 512-517, 200/1 B; H01H 1/00

[56] References Cited

U.S. PATENT DOCUMENTS

| | | | |
|---|---|---|---|
| 3,973,091 | 8/1976 | Kaminski | 200/5 A |
| 3,996,429 | 12/1976 | Chu et al. | 200/5 A |
| 4,314,117 | 2/1982 | Ditzig | 200/5 A |
| 4,319,099 | 3/1982 | Asher | 200/5 A |
| 4,400,596 | 8/1983 | Fukukura et al. | 200/5 A |
| 4,477,700 | 10/1984 | Balash et al. | 200/5 A |
| 4,892,981 | 1/1990 | Soloway et al. | 200/5 A |
| 4,987,275 | 1/1991 | Miller et al. | 200/5 A |

*Primary Examiner*—J. R. Scott
*Attorney, Agent, or Firm*—Ratner & Prestia

[57] ABSTRACT

A push switch is capable of performing a first switching operation and subsequently a second switching operation when a pressing force is applied to the switch. The push switch includes (a) an insulating membrane having at least one dome with at least a portion thereof overlaid by or serving as an inner conductor and at least a portion of its outer periphery overlaid by or serving as an outer conductor, (b) an insulating substrate having thereupon an inner pole contact disposed at a position opposing to the inner conductor and an outer pole contact disposed at a position opposing to the outer conductor, respectively, and (c) a spacer placed between the insulating membrane and the insulating substrate for spacing the conductor apart from the pole contacts during the time when no pressing force is applied to the switch. When a light pressing force is applied to the dome, the outer conductor will first come in contact with the outer pole contact causing a first switching operation to take place, and subsequently with a further pressing, the inner conductor will come in contact with the inner contact causing a second switching operation to take place.

14 Claims, 6 Drawing Sheets

PUSH BUTTON SWITCH ASSEMBLY INCLUDING SINGLE OR PLURAL SEQUENTIALLY CLOSED SWITCHES

BACKGROUND OF THE INVENTION

The present invention relates to a push switch which can present a two step switching operation by pressing it and finds applications in various kinds of electronic equipment such as video cameras, video cassette recorders, facsimile machines and the like.

In recent years as a multiple function is required more and more of many kinds of electronic equipment, demands for a push switch capable of performing the two step switching operation have been increasing.

With this type of switch, when its push button is lightly pressed by finger touching, a first switching mechanism is actuated and subsequently when the push button is further pressed, a second switching mechanism is actuated.

In its typical application, the first switching step is used for getting a certain function of electronic equipment into a preparatory mode and the second switching step is used for getting that specific function into a full operational mode.

A more detailed description of the prior art push switches of the kind mentioned above is given in the following:

FIGS. 1(*a*)–1(*c*) is a partially cross-sectional view of one switch element of the typical prior art push switch.

In FIGS. 1(*a*)–1(*c*) an insulative substrate has disposed thereon one or more switch elements.

One switch element disposed on the insulative substrate 1 comprises a first pole contact 2 shaped like a "C" letter, a second pole contact 3 shaped like another "C" letter and disposed inside the first pole contact 2, a third disc shaped pole contact 4 disposed inside the second pole contact 3 and conductor leads (not shown) connected to these pole contacts 2, 3 and 4, respectively.

Over the first pole contact 2 and the second pole contact 3 are placed an upper side diaphragm 5 and a lower side diaphragm 6, respectively, which are dome shaped and made from an electro-conducting and elastic metal.

The upper side diaphragm 5 is covered by a insulating membrane 7 and fixed to the first pole contact 2, and also the lower side diaphragm 6 is fixed to the second pole contact 3 by soldering and the like to complete the switching element.

Further, over the upper side diaphragm 5 is disposed a push button 8, movement of which is guided by a panel 9 placed above the switch element.

Next, the operation of this push switch will be explained.

When the push button 8 is pressed lightly by a finger, the upper side diaphragm 5 will come in touch with the lower side diaphragm 6 to make contact between the first pole contact 2 and the second pole contact 3 as shown in FIG. 1(*b*), causing a first switching operation to take place.

Then, when the push button 8 is pushed strongly further, the lower diaphragm 6 will come in touch with the third pole contact 4 as shown in FIG. 1(*c*) to make contact between the second pole contact 3 and the third pole contact 4, causing a second switching operation to take place. When the finger pressure is removed from the push button 8, the diaphragms 5 and 6 will return to their original shapes as shown in FIG. 1(*a*) by their elastic springback force to break contact between the pole contacts with a resultant cancellation of the first and second switching operations.

In the above prior art example, a push switch of applying pressure to diaphragms through a push button was presented but also there is a push switch type wherein the diaphragms are pressed directly by a finger without using the push button.

However, the conventional push switches as described in the foregoing require two diaphragms to make one switch element, resulting in such problems as too many component parts required, a complicated assembly process due to a high mechanical precision needed in positional alignments of diaphragms and a likelihood of ending up with a high production cost.

SUMMARY OF THE INVENTION

The present invention provides a push switch which requires a less number of component parts, facilitates easy assemblage and makes a two step switching operation possible.

The push switch as disclosed by the present invention comprises (a) a membrane having at least one dome means with at least a portion of said dome means overlaid by or serving as an inner conductor and at least a portion of the outer periphery of said dome means overlaid by or serving as an outer conductor, (b) an insulating substrate having thereupon an inner pole contact disposed at a position opposing to said inner conductor and an outer pole contact separated from said inner pole contact and disposed at a position opposing to said outer conductor and (c) a separation means for spacing said conductors overlaid on the membrane apart from said pole contacts disposed on said insulating substrate when any pressing force is not applied to the switch.

When a pressing force is applied to the switch, the outer conductor will come first in touch with the outer pole contact causing a first switching operation to take place and subsequently, while the first switching operation is being maintained, the inner conductor will come in touch with the inner pole contact with a resultant second switching operation taking place.

According to this construction, the deflection of the dome means caused by an application of a pressing force will take place only when the second switching operation is performed and the two step deflection as was needed with the prior art will not be required.

Therefore, even when the dome means is formed of a membrane having a diaphragm of a material different from the membrane incorporated, only one diaphragm is required resulting in a reduction of the component parts needed. Besides, when the dome means is made by molding of a membrane, two diaphragms as were needed with the prior art will not be required with a resultant reduction in the number of component parts.

Especially, with a push switch assembly where a plurality of switch elements are disposed and a membrane having a plurality of dome means formed by a simultaneous molding is employed, the number of component parts will be drastically reduced and the positional alignment of individual diaphragm which was needed with the prior art will no longer be required resulting in a very simplified assembly work.

With the foregoing push switch of the present invention, it is desirable to use an insulating resin such as polyester and the like on account of elasticity for a good clicking action, insulation and cost to form the membrane having the dome means. However, in that case, a conductor consisting of an electro-conductive material is to be formed on the down side surface of the membrane.

In addition, it is not necessary to form the inner conductor and outer conductor separately but the both can be formed at the same time into an integral body.

As a material of the membrane, an elastic electro-conductive material such as phosphor bronze and the like can be used. In that case, the forming process of the conductor can be eliminated since the membrane itself serves as the conductor.

In connection with the pole contacts arranged on the upper side surface of the insulating substrate, it is desirable to make the shape of the outer pole contact like a loop with one portion of it missing and being open. In this opening portion of the loop is arranged the lead conductor of the inner pole contact.

According to this arrangement of pole contacts, the outer and inner pole contacts and the lead conductors thereof can be formed simultaneously either by printing of electro-conductive material or etching of conductor foils, resulting in a simplified production process.

Also, a provision for separating the lead conductor of the inner pole contact from the outer conductor by means of an insulating layer which was formed, for example, by covering the upper surface of the lead conductor opposing to the outer conductor with an insulative resin can prevent a short circuiting between the inner pole contact and the outer conductor which might be caused accidentally by the lead conductor coming in touch with the outer conductor during the first switching operation.

As a means of separating the conductor from the pole contacts, a spacer like an insulating film, etc. can be disposed between the membrane and the insulating substrate to readily secure a spacing between the two, thus contributing to a simplified assembly work of the push switch.

Although the push switch of the present invention does not necessarily require a push button, its use will contribute more to an error free and secure switching operation by making the pressing force to apply to the center of the dome means when compared with the case of the pressing force applied directly to the dome means by finger.

DETAILED DESCRIPTION OF THE PREFERRED EMBODIMENTS

Embodiment 1

Figure 1A:
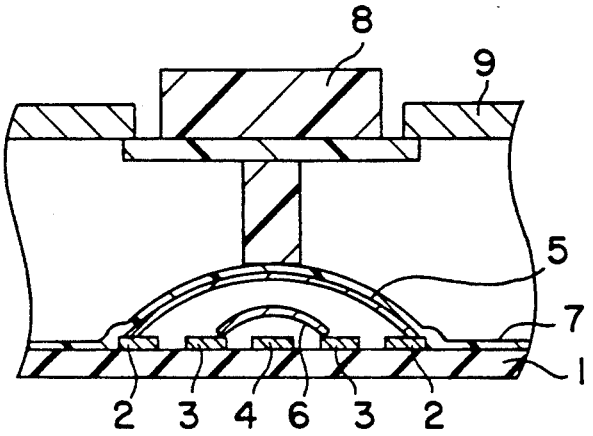
FIG. 1(a) PRIOR ART
FIGS. 1(*a*)–1(*c*) show cross-sectional views of a typical prior art push switch illustrating its construction and operation.
Figure 1B:
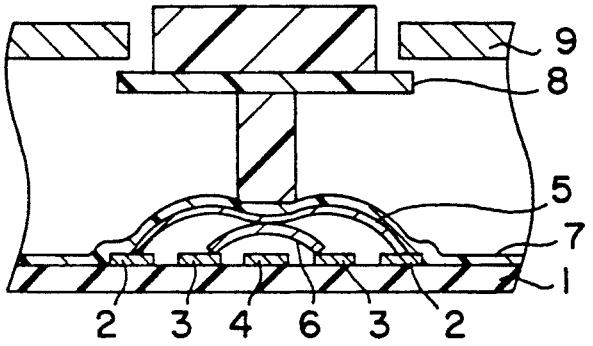
FIG. 1(b) PRIOR ART
Figure 1C:
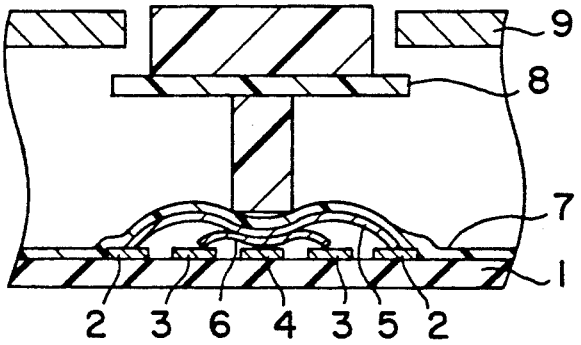
FIG. 1(c) PRIOR ART
Figure 2A:
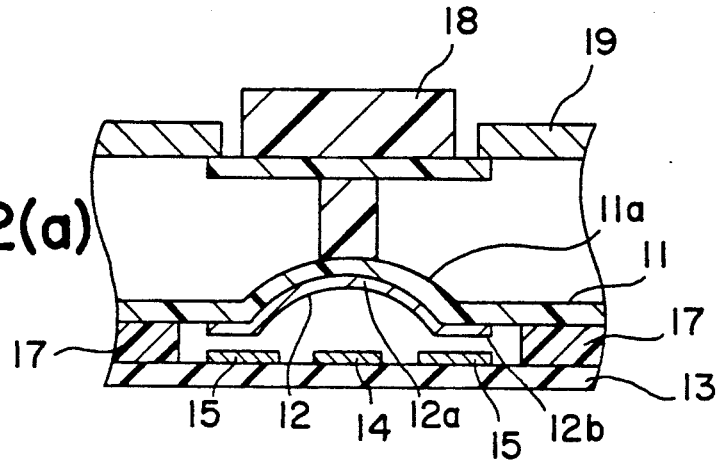
FIGS. 2(*a*)–2(*c*) show cross-sectional views of a push switch presented as a first embodiment of the present invention to illustrate its construction and operation.
Figure 2B:
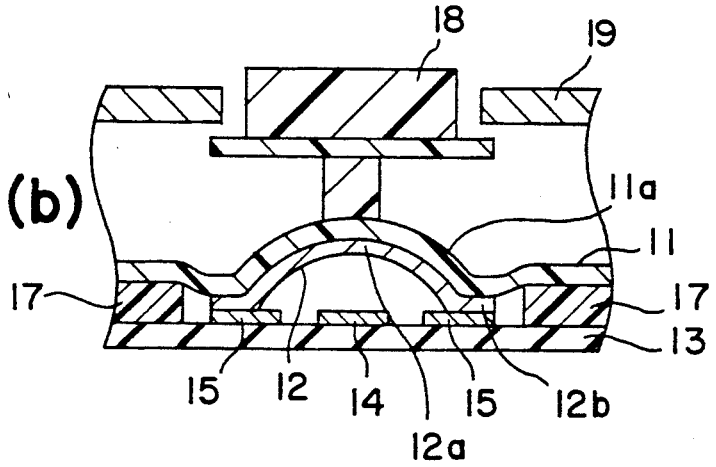
Figure 2C:
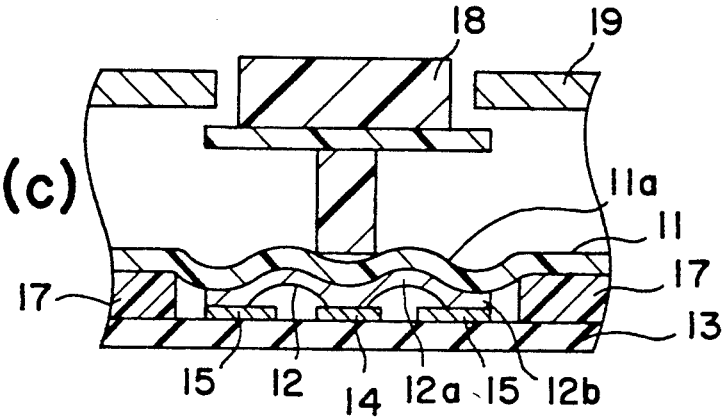
Figure 3:
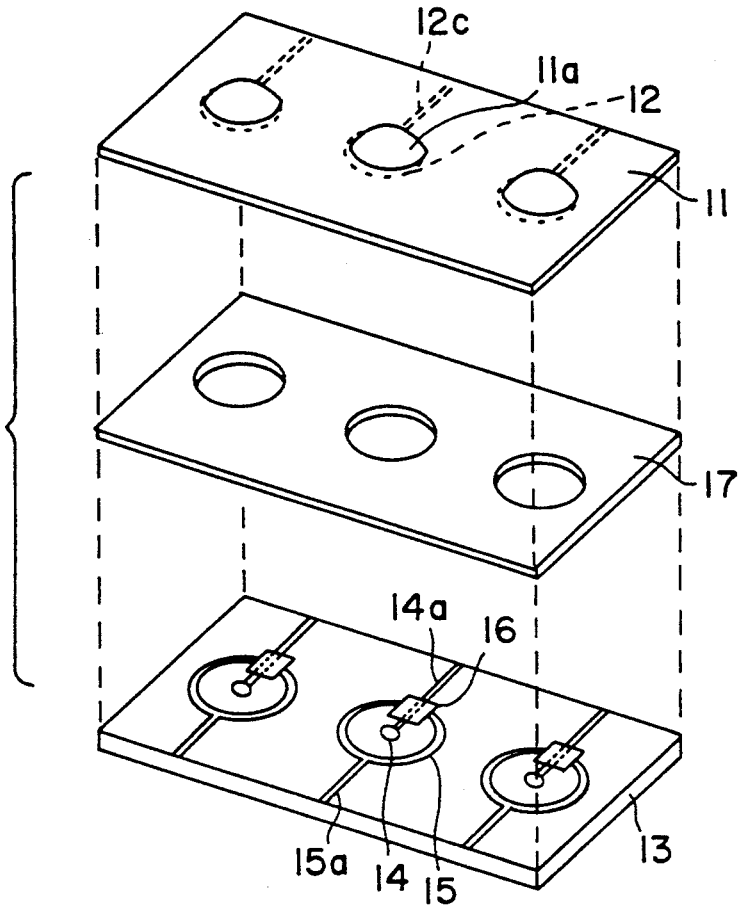
FIG. 3 shows a perspective exploded view of the parts comprising the switch.

In FIGS. 2(*a*)–2(*c*) and FIG. 3, an insulating membrane 11 is composed of polyester resin, which has a dome means 11*a* formed by molding into a semi-spherical shape.

A conductor 12 is formed on the down side surface of the membrane 11 by printing an electro-conductive paste comprised of silver and carbon.

Here, an inner conductor 12*a* formed all over the down side surface of the dome means 11*a* and an outer conductor 12*b* formed on the periphery of the down side surface of the dome means 11*a* are formed into an integral body. Also, a lead conductor 12*c* connected with the conductor 12 is printed at the same time as the conductor 12 is printed.

An insulating substrate 13 is composed of phenol resin filled paper.

On the upper side surface of the insulating substrate 13 are formed a disc shaped inner pole contact 14 at a position opposing to the center of the inner conductor 12*a* and a lead conductor 14*a* connected with the inner pole contact 14, and an outer pole contact 15 of a shape like a circular ring, part of which is missing, at a position opposing to the outer conductor 12*b* and a lead conductor 15*a* connected with the outer pole contact 15.

These pole contacts 14, 15 and lead conductors 14*a*, 15*a* are formed by printing the foregoing electro-conductive paste. In addition, the area where the lead conductor 14*a* is held between two ends of the ring shaped pole contact 15 is covered with an insulating layer 16 formed by printing epoxy resin.

A spacer 17 is formed of polyester film for spacing the outer conductor 12*b* from the outer pole contact 15 when a pressing force is not applied to the switch. The spacer 17 is held between the membrane 11 and the insulating substrate 13 and adhered to both by means of adhesive resin.

A push button 18 is disposed on top of the dome means 11*a* and item 19 is a protector panel, also serving as a movement guide to the push button 18.

Figure 4A:
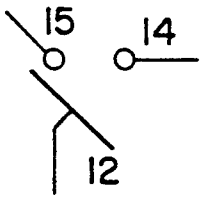
FIGS. 4(*a*)–4(*c*) show circuit diagrams to explain the operation of the switch.
Figure 4B:
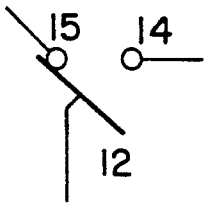
Figure 4C:
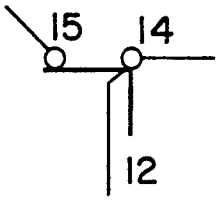

Next, the operation of this push switch will be explained with the help of FIGS. 2(*a*)–2(*c*) and FIGS. 4(*a*)–4(*c*). When the push button 18 is pressed lightly by a finger, the outer peripheral portion of the dome means 11*a* will be deformed and, as shown in FIG. 2(*b*) and FIG. 4(*b*), the outer conductor 12*b* of the conductor 12 will come in contact with the outer pole contact 15 causing a first switching operation to take place. Subsequently, when the push button 18 is further pressed strongly, the central portion of the dome means 11*a* will be deformed and the inner conductor 12*a* of the conductor 12 will come in contact with the inner pole contact 14 causing a second switching operation to take place while the first switching operation is still being maintained. When the pressing force is removed, the deformations of the dome means 11*a* and the vicinity of its outer peripheral portion will be restored to original conditions and, as shown in FIG. 2(*a*) and FIG. 4(*a*), the first and second switching operations will be disengaged.

Thus, according to the set-up of Embodiment 1, the two diaphragms as were required in the prior art are no longer needed, resulting in a reduction of the component count. Besides, a simple process of putting together the membrane 11, the spacer 17 and the insulating substrate 13 by means of adhesive makes the assembly of the push switch easy.

Moreover, if the first switching operation can be positively confirmed through a display means which is turned on by the push button 18 being pressed lightly, then only after a confirmation of the display means, the second switching operation will be performed while a click caused by a tactile deflection of the central portion of the dome means 11*a* is being sensed, leading to elimination of any possibilities of erroneous operations of the equipment intended for a control by the push switch.

Although an example wherein polyester, presenting an excellent clicking action, was used as the material of the membrane 11 has been explained in the present Embodiment 1, such other materials as polyimide, vinyl chloride, polycarbonate and the like can also be used.

Also, although an electro-conductive paste composed mainly of silver and carbon which are inexpensive and yet excellent in electro-conductivity was used in forming by printing the conductor 12 and the pole contacts 14 and 15 with the present Embodiment 1, other electro-conductive pastes composed mainly of silver, copper, nickel, gold, palladium, carbon and the like can be used.

Besides, instead of printing an electro-conductive paste, a method of etching such metal foils comprised of silver, copper, nickel, gold, palladium and the like can also be employed to form the required patterns. As the material of the insulating substrate 13, an inexpensive paper-phenolic board was used in the present Embodiment 1, but other boards such as a glass-epoxy board having excellent heat resistance and being prepared by impregnating a laminated glass cloth (i.e., a cloth woven by glass fibers) with epoxy resin, a metal board coated with such an insulating layer as glass, etc., a flexible board formed of polyimide and the like can also be used.

In place of the epoxy resin as used with the insulative layer 16 in the foregoing, such other kinds of resin as polyester, vinyl chloride, polyimide and the like can be used in the layer to be printed.

Further, instead of printing the layer, covering by adhesive films composed of the foregoing kinds of resin can also be employed.

As the material of the spacer 17, films of such kinds of resin as vinyl chloride, polyimide, epoxy and the like are preferred in addition to a polyester film as was used in the present Embodiment 1.

However, depending on such requirements as strength, etc., other materials such as a metal and the like may have to be used.

Embodiment 2

Embodiment 2 is a case wherein the resin membrane 11 composing the conductor 12 of Embodiment 1 as shown in FIGS. 2(*a*)–2(*c*) and FIG. 3 was replaced by a metallic membrane formed by molding a phosphor bronze sheet to make the dome means.

By employing a metallic membrane, forming of the conductor 12 becomes unnecessary and this process can be eliminated since the membrane itself is electro-conductive.

As the metallic membrane, other kinds of elastic metal such as stainless steel, beryllium copper, etc. in addition to the foregoing phosphor bronze can also be used.

Also, a metal-resin composite membrane wherein only the dome portion and the outer vicinity of its periphery are formed of metal and other flat portions are formed of resin can be used.

Embodiment 3

Figure 5:
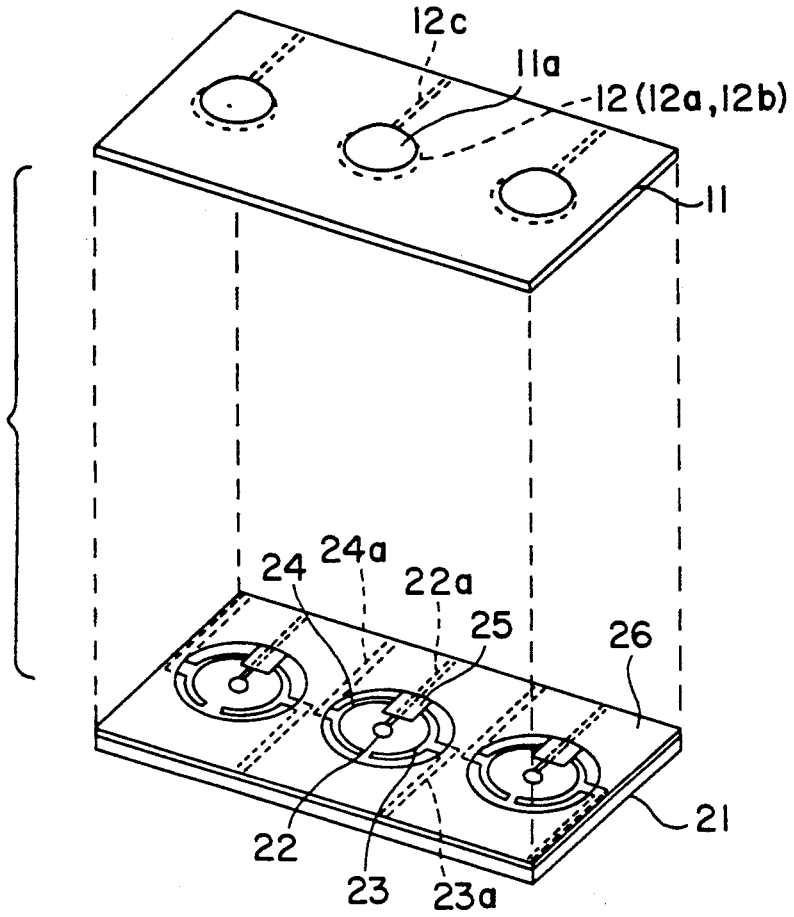
FIG. 5 shows a perspective exploded view of the parts comprising a push switch presented as a third embodiment of the present invention.

FIG. 5 shows perspective exploded drawings pertaining to Embodiment 3.

The membrane 11 and the conductor 12 formed thereunder are the same ones as were shown in FIGS. 2(*a*)–2(*c*) and FIG. 3 for Embodiment 1.

A glass-epoxy substrate 21 has formed thereon by a printing method using an electro-conductive paste composed mainly of silver and carbon an inner pole contact 22, a first outer pole contact 23 and a second outer pole contact 24 and lead conductors 22*a*, 23*a* and 24*a* connected with the foregoing pole contacts 22, 23 and 24 respectively. In addition, an insulating layer 25 of epoxy resin is formed by printing over the lead conductor 22*a* of the inner pole contact 22.

A spacer 26 is composed of epoxy resin and formed by a printing method to cover the surface area of the substrate 21 except for the regions occupied by the pole contacts 22, 23 and 24 and the vicinity thereof.

Assembly of a push switch will be completed by pasting together the spacer 26 and the membrane 11.

The operation of this push switch is fundamentally the same as the one of Embodiment 1, except for a function wherein two circuits are simultaneously turned on by the first switching operation due to splitting the outer pole contact into two.

Figure 6A:
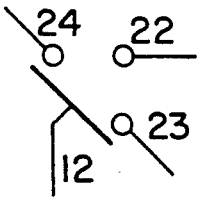
FIGS. 6(*a*)–6(*c*) show circuit diagram for explaining the operation of the push switch.
Figure 6B:
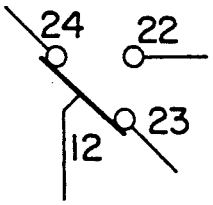
Figure 6C:
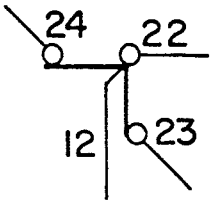

In other words, when the dome means 11*a* is lightly pressed, the outer conductor 12*b* of the conductor 12 will come in contact with the outer pole contacts 23 and 24, shifting the switching state of FIG. 6(*a*) to that of FIG. 6(*b*) and with further pressing of the dome means 11*a* the inner conductor 12*a* will come in contact with the inner pole contact 22, shifting the switching state further to that of FIG. 6(*c*). Thus, it will be possible to turn on two circuits at the same time by having the outer pole contact divided into two sections.

It will also be possible to turn on three or more circuits simultaneously by having the outer pole contact split into three or more sections.

The spacer 26 of the foregoing push switch was prepared by a printing method. The printing method makes it possible to achieve a high accuracy in dimensions and in positions as well, and is suited to building high precision push switches, especially those having a plurality of switch elements disposed.

Embodiment 4

Figure 7:
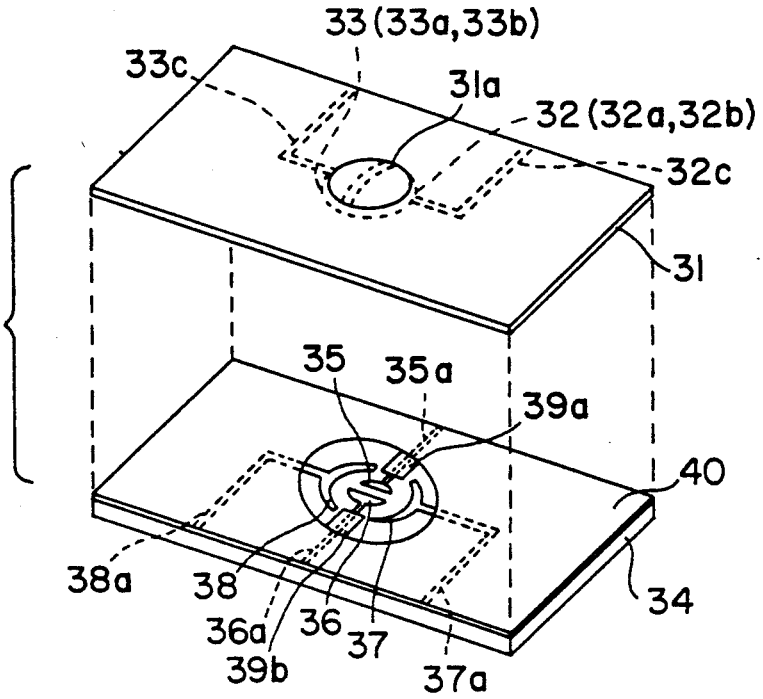
FIG. 7 shows a perspective exploded view of the parts comprising a push switch presented as a fourth embodiment of the present invention.

Embodiment 4 pertains to a push switch wherein each of the conductor, inner pole contact and outer pole contact is divided into two sections respectively for an increase of the number of switches to be turned on as shown in perspective exploded views of FIG. 7.

A first conductor 32 and a second conductor 33 are formed on a dome means 31*a* and on its outer periphery, both of a polyester membrane 31 and having a quadrantal sphere shape, and items 32*c* and 33*c* are lead conductors connected with the first conductor 32 and the second conductor 33, respectively.

A glass-epoxy substrate 34 has a semi-circular first inner pole contact 35 and a semi-circular second inner pole contact 36 and lead conductors 35*a* and 36*a* thereof, and a semi-circular ring-like first outer pole contact 37 and a semi-circular ring-like second outer pole contact 38 and lead conductors 37*a* and 38*a* thereof are formed by a printing method employing an electro-conductive paste composed mainly of silver and carbon.

Further, insulating layers 39*a* and 39*b* of epoxy resin are formed by printing over the lead conductors 35*a* and 36*a*, respectively, and a spacer 40 of epoxy resin is formed by printing on the surface of the substrate 34 except for the regions of the pole contacts 35, 36, 37 and 38, and the insulating layers 39*a* and 39*b* and the vicinity thereof. The membrane 31 and the spacer 40 are pasted together to complete a push switch.

When the dome means 31*a* of the push switch is pressed lightly, the outer conductor 32*b* of the first conductor 32 will come in contact with the first outer pole contact 37 and at the same time the outer conductor 33*b* of the second conductor 33 will come in contact with the second outer pole contact 38.

With a further strong pressing of the dome means 31*a*, the inner conductors 32*a* and 33*a* will come in contact with the inner pole contacts 35 and 36, respectively, owing to a tactile deflection of the central portion of the dome means 31*a*.

Accordingly, the number of the circuits to be switched can be increased by dividing each respective inner pole contact and outer pole contact into two sections. By increasing the number of divisions, the number of circuits to be switched can be further increased.

Embodiment 5

Figure 8:
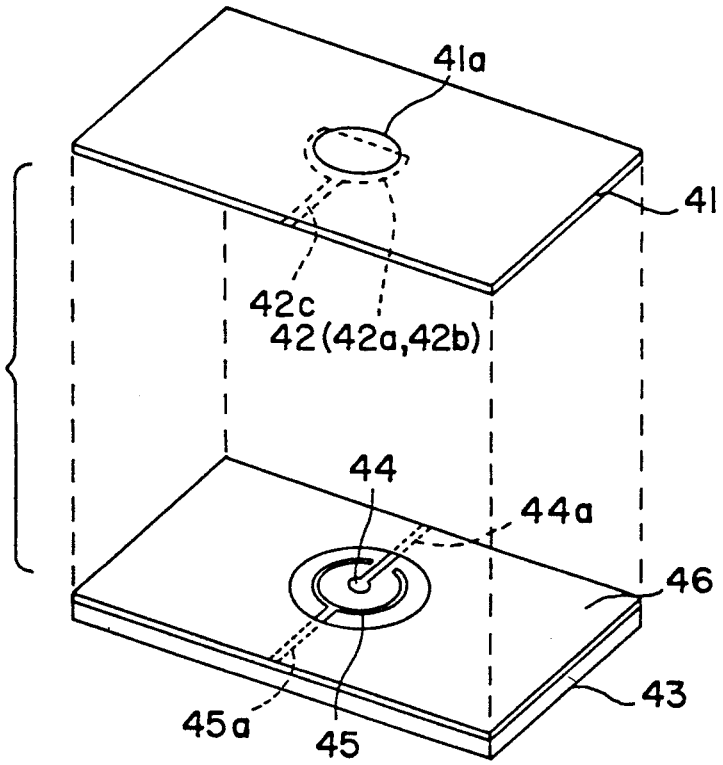
FIG. 8 shows a perspective exploded view of the parts comprising a push switch presented as a fifth embodiment of the present invention.

Embodiment 5 as illustrated in FIG. 8 is a case wherein the insulating layer 16 is omitted from Embodiment 1 as was shown in FIG. 3.

As seen in FIG. 8, a dome means 41*a* formed on an insulating membrane 41 and a conductor 42 formed on the outer periphery thereof are shaped like a semi-sphere wherein a bow like sector opposing to a lead conductor 44*a* of an inner pole contact 44 is missing.

By having the conductor 42 shaped like this, contacting between the lead conductor 44*a* of the inner pole contact 44 and the outer conductor 42*b* can be avoided during a first switching operation when the outer conductor 42*b* comes in contact with the outer pole contact 45.

By having a section of the conductor 42 and also the inner conductor 42*a* thus omitted, the insulating layer can be eliminated.

The configuration of the section omitted was bow-shaped in the foregoing case but it can be a different shape, such as a "U" letter shape, etc., for instance.

In FIG. 8, the insulating membrane 41, the conductor 42, the insulating substrate 43, the inner pole contact 44, the outer pole contact 45 and the lead conductors 42*c*, 44*a* and 45*a* are the same in material as used in Embodiment 1 except for the spacer 46 which is formed by printing of epoxy resin with Embodiment 5.

Embodiment 6

Figure 9:
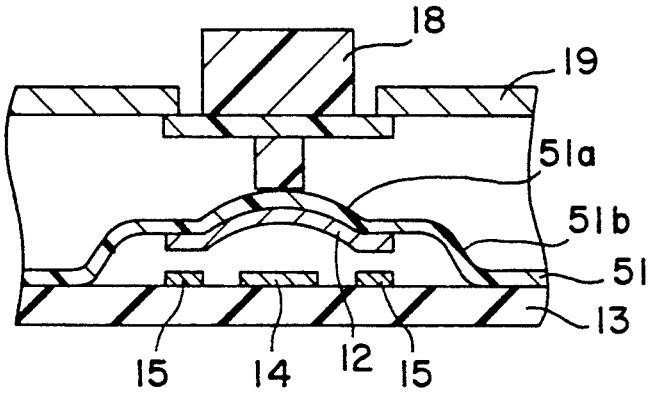
FIG. 9 is a cross-sectional view of a push switch presented as a sixth embodiment of the present invention.

FIG. 9 pertains to Embodiment 6, wherein a separation means of the spacer 17 as used in Embodiment 1 for separating the conductor 12 from the pole contacts 14 and 15 was replaced by a different means.

In Embodiment 6, an elevated ring shaped step portion 51*b* is formed by a molding method in the vicinity of the outer periphery of a dome means 51*a* made on a polyester resin membrane 51 and is serving as a separation means. When no pressing force is applied to the push switch, the step portion 51*b* keeps by its elasticity a space between the conductor 12 and the pole contacts 14 and 15. Accordingly, it will be possible to use other separation means than the spacer 17 as exemplified in the foregoing.

According to the present invention, there are many more modifications than the ones exemplified by the foregoing embodiments.

In Embodiment 1, for example, a push switch wherein a dome means is pressed by means of a push button was described, but the present invention will not be limited to this construction.

A push switch having a construction wherein the dome means is directly pressed by finger will be also included in the present invention.

Besides, the configuration of the dome means will not be necessarily limited to a semi-sphere but it can possibly be other shapes such as a semi-ellipsoid and the like. All in all, any modifications which remain along the true spirit and within the scope of the present invention will be covered by what is claimed by the present invention.

What is claimed is:

1. A push switch capable of performing a two step switching operation in response to a pressing force, said push switch comprising:

an insulating substrate having disposed thereon at least one outer pole contact and at least one inner pole contact, electrically insulated from said outer pole contact; and dome means including an extending peripheral area, said dome means having an electrically conductive surface, said conductive surface being disposed opposing said inner and outer pole contacts wherein:

(i) said conductive surface of said peripheral area contacts said outer pole contact when a first pressing force is applied to the dome means at a first time, and (ii) said conductive surface contacts said inner pole contact, while maintaining contact between said conductive surface of said peripheral area and said outer pole contact, when a second pressing force, which is greater than said first pressing force, is applied to the dome means at a second time different from said first time.

2. A push switch according to claim 1, wherein said dome means and said peripheral area comprise an insulating resin, an inner conductor formed on said dome means, and an outer conductor formed on said peripheral area.

3. A push switch according to claim 1, wherein said dome means and said peripheral area comprise an electro-conductive metallic material.

4. A push switch according to claim 1, wherein said outer pole contact is circular ring shaped, at least a part of which is missing and said inner pole contact is connected with a lead conductor disposed on at least one place of the missing part of said circular ring-like outer pole contact.

5. A push switch according to claim 4, further comprising an insulating layer disposed in said missing part of said outer pole contact for electrically isolating said lead conductor from said conductive surface.

6. A push switch according to claim 1, further comprising a push button on top of said dome means and a panel serving as a movement guide for the push button.

7. A push switch according to claim 1, wherein:

said at least one inner pole contact includes one inner pole contact;

said at least one outer pole contact includes two outer pole contacts disposed on either side of said inner pole contact;

said outer pole contacts said conductive surface during said first and second switching operations; and said inner pole contact contacts said conductive surface during said second switching operation.

8. A push switch according to claim 1, wherein:

said outer pole contact is separated from said conductive surface by a first distance in the absence of pressing force; and said inner pole contact is separated from said conductive surface by a second distance, greater than said first distance, in the absence of pressing force.

9. A push switch according to claim 1, further comprising separation means for preventing said conductive surface from contacting said pole contacts in the absence of said pressing force.

10. A push switch according to claim 9, wherein said separation means comprises a spacer disposed between said insulating substrate and a membrane comprising said dome means and said peripheral area.

11. A push switch according to claim 1, wherein said conductive surface of said outer peripheral area is substantially parallel to said outer pole contact.

12. A push switch according to claim 1, wherein said conductive surface of said peripheral area contacts said outer pole contact to form a first contact area and a first electrical connection and wherein said conductive surface contacts said inner pole contact to form a second contact area and a second electrical connection.

13. A push switch according to claim 12, wherein said first contact area and said second contact intersect the same horizontal plane.

14. A push switch according to claim 1, wherein said dome means has an outer edge and wherein said outer peripheral area includes said outer edge and wherein when said conductive surface of said peripheral area contacts said outer pole contact and when said conductive surface contacts said inner pole contact said outer edge remains in contact with said outer pole contact.

* * * * *